US006763675B1

(12) United States Patent
Fleeman

(10) Patent No.: US 6,763,675 B1
(45) Date of Patent: Jul. 20, 2004

(54) APPARATUS AND METHOD FOR PREPARING, CHILLING AND DISPENSING A BEVERAGE

(76) Inventor: John H. Fleeman, 1244 First Ave., Lawrenceburg, TN (US) 38464

( * ) Notice: Subject to any disclaimer, the term of this patent is extended or adjusted under 35 U.S.C. 154(b) by 0 days.

(21) Appl. No.: 10/447,738

(22) Filed: May 29, 2003

(51) Int. Cl.[7] ..... B67D 5/62
(52) U.S. Cl. ..... 62/386; 62/389; 62/396
(58) Field of Search ..... 62/386, 389, 396, 62/398, 98

(56) References Cited

U.S. PATENT DOCUMENTS

| | | | | |
|---|---|---|---|---|
| 706,510 | A | 8/1902 | Barrath | |
| 2,049,902 | A | 8/1936 | Fischer | 62/108.5 |
| 2,549,747 | A | 4/1951 | Leeson | 62/106 |
| 2,796,742 | A | 6/1957 | Platt | 62/108.5 |
| 3,206,944 | A | 9/1965 | Gallo | 62/347 |
| 3,580,008 | A | 5/1971 | Barnard | 62/347 |
| 4,562,991 | A | 1/1986 | Wu | 249/141 |
| 5,419,151 | A | 5/1995 | Minari | 62/347 |
| 5,711,892 | A | 1/1998 | Ramirez | 249/105 |
| 5,950,866 | A | 9/1999 | Lancaster | 222/1 |
| 6,187,230 | B1 | 2/2001 | Clarke | 264/28 |

*Primary Examiner*—Chen Wen Jiang
(74) *Attorney, Agent, or Firm*—Waddey & Patterson, PC; Howard H. Bayless

(57) ABSTRACT

An apparatus and method for preparing, chilling and dispensing a beverage is disclosed. The apparatus comprises a plate of frozen plate material supported by a base block. At least one conduit is cut into the frozen plate. The conduit 40 may be an open channel, partially enclosed channel or a tube. When the apparatus is oriented for use, the plate is fixed at a downward slope angle such that the conduit follows a overall downward path. A beverage is poured from a dispenser into the conduit at a beverage entry. The beverage flows down the conduit contacting and being chilled by the conduit surface. A portion of the conduit surface may melt and enter the beverage. The beverage is then collected in a receptacle.

46 Claims, 4 Drawing Sheets

APPARATUS AND METHOD FOR PREPARING, CHILLING AND DISPENSING A BEVERAGE

BACKGROUND OF THE INVENTION

The present invention relates generally to devices and methods for preparing and dispensing beverages and, more particularly, to non-pressurized, gravity flow devices and methods for preparing and dispensing beverages. As used herein, the term beverage refers to a fluid suitable for human consumption and also refers to any component fluids or component mixtures of fluids and solids used to make the beverage. Therefore the term beverage may encompass, but is not limited to, a single fluid, a mixture of component fluids, a colloidal fluid mixture, a mixture of fluids and solids, or a slush of fluids and solids. The term component beverage materials encompasses any subset of the components of a beverage. Fluids encompass, but are not limited to, liquids, liquids with dissolved gases and liquids with dissolved solids.

Persons desiring to prepare and dispense a chilled beverage currently have several conventional options. A beverage may be made, stored in a container, placed in a refrigerator or other chilling device, cooled to the desire temperature, then decanted and served. Optionally the beverage or its component fluids maybe dispensed using machines that flow, under pressure, the beverage through a heat exchanger for chilling using any of a number of conventional heat exchanger mechanisms. Also, the beverage may be served in a container containing ice or other frozen material. Finally, the beverage may be placed in a shaker container containing ice or other frozen material, shaken and chilled by the frozen material, then decanted into a container.

Caterers, proprietors of drinking establishments, and others involved in the beverage service industry frequently wish to combine the preparation of chilled beverages with an aesthetically pleasing environment. One measure of the aesthetics of an apparatus is adaptability to the decor of the establishment or function in which it is being used. Ice and similar frozen materials are frequently used in catering devices. For example, ice sculptures are favorite decorative devices for drinking establishments and catering events. Similarly, serving bowls made of ice are catering devices made of a frozen material. By contrast, beverage fountain devices are usually made of glass or metal, and have a pump or similar mechanism for flowing the beverage under pressure.

What is needed is an apparatus and method for preparing, chilling and dispensing a beverage utilizing a frozen material.

SUMMARY OF THE INVENTION

An apparatus and method for preparing, chilling and dispensing a beverage is disclosed. The apparatus comprises a plate of frozen plate material supported by a base block. At least one conduit is cut into the frozen plate. The conduit 40 may be an open channel, partially enclosed channel or a tube. When the apparatus is oriented for use, the plate is fixed at a downward slope angle such that the conduit follows a overall downward path. A beverage is poured from a dispenser into the conduit at a beverage entry. The beverage flows down the conduit contacting and being chilled by the conduit surface. A portion of the conduit surface may melt and enter the beverage. The beverage is then collected in a receptacle.

DESCRIPTION OF THE PREFERRED EMBODIMENTS

Figure 1:
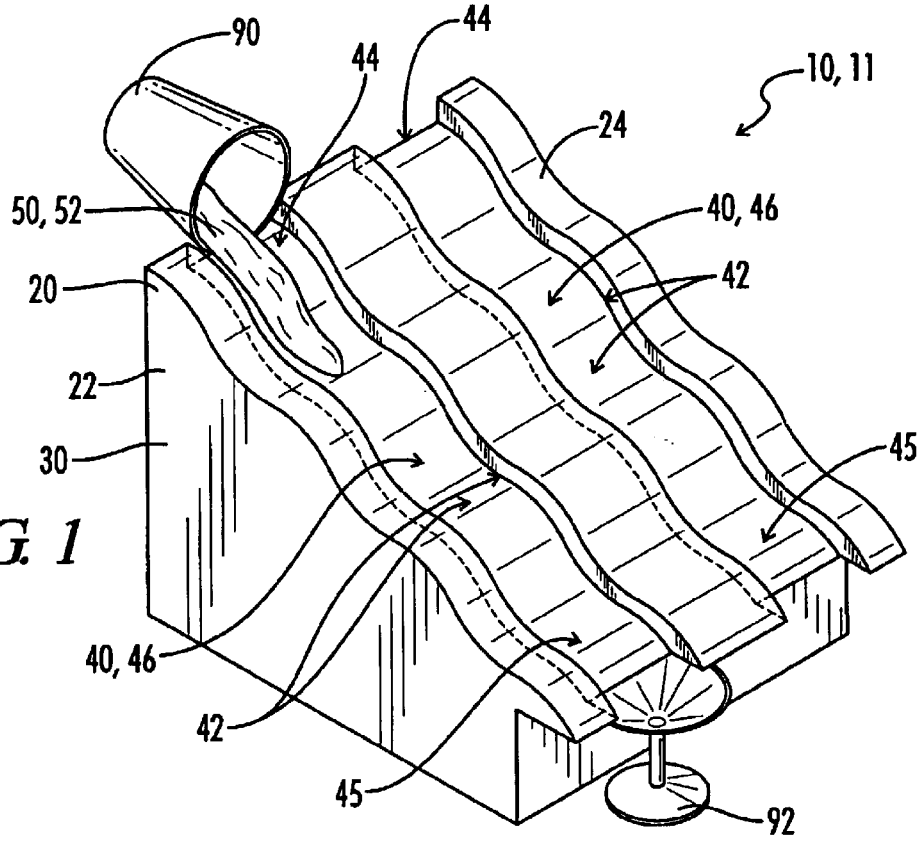
FIG. 1 is a front oblique perspective of the present invention.

Referring now to FIG. 1, the apparatus 10 of this device is shown as a frozen casting 11 for the preparation, chilling and dispensing a beverage 50. The term frozen is herein defined to mean comprised of generally solidified materials having an average temperature at or below the standard refrigeration temperature for the type of beverage being prepared. For example, if the frozen casting 11 was comprised of ice, its average temperature would be 32° F. or less.

The apparatus comprises a plate 20 of frozen plate material 22 for flowing and chilling a beverage 50. The plate 20 is supported by a base block 30 which contacts the under portion of the plate 20 and allows the plate 20 to rest on the basis block 30. At least one conduit 40 is cut into the frozen plate 20. In this embodiment, the conduit 40 is shown as an open channel. However, the conduit 40 could also be fully or partially enclosed or could be formed as a tube. When the apparatus is oriented for use, the plate 20 is fixed at a downward slope angle such that the conduit 40 follows a overall downward path. Since the apparatus 10 is a flows the beverage 50 by gravity, the term downward or down-slope is used to describe a direction or path that decreases the potential energy of a body moving in that direction or along that path. The term upward or up-slope is used to describe a direction or path that increases the potential energy of a body moving in that direction or along that path. The term transverse or cross-slope is used to describe a direction that produces no change in the potential energy of a body moving in that direction.

FIG. 1 shows a beverage 50 poured from a dispenser 90 into the conduit 40 at a beverage entry 44. The beverage 50 flows down the conduit 40 contacting and being chilled by the conduit surface 42, which is a portion of the surface of the plate 20 and is formed from the frozen plate material 22. In this embodiment, the conduit 40 follows the contours of the plate 20 as it moves down the slope. It is apparent that the conduit 40 does not have to take a direct linear path down the slope, but may be angled and curved along the face of the slope. As well, the conduit 40 may change in height and depth as it goes down slope through the plate 20. The beverage 50 is in contact with the conduit surface 42 while flowing through the conduit 40. Thus, the beverage 50 is in thermal communication with frozen plate material 22 and is chilled thereby. The beverage 50 exits the conduit 40 at the beverage exit 45 and flows into a receptacle container 92. The beverage 50 is flowed by gravity and it requires no pressurization.

The frozen plate material 22 can be made of materials common in the beverage industry including ice, solidified carbon dioxide ('dry ice') and various frozen beverage materials. Such beverage materials can be selected from the group comprising water, ice water solution, alcoholic beverages, carbonated beverages, flavored beverages, teas, coffees, juices, portions of solidified fruit, spices or flavoring agents. The slope of the plate 20 and conduit 40 length determines the speed of the flow of the beverage 50. The average temperature of the plate 20, the average temperature of the beverage 50 to be poured, and the selection of conduit 40 length, surface area, and shape, are additional factors in determining the desired heat exchange characteristics of the apparatus 10. For example, an frozen casting 11 of the embodiment shown in FIG. 1 made of ice at or below 32° F. is used for preparing, chilling and dispensing a martini beverage when the beverage components to be poured are at ambient temperature of 68° F. The overall dimensions are 18 inches in height, 25 inches in length and transverse width of 12 inches. The length of the plate 20 lies generally along the hypotenuse of a triangle having a height of 12 inches and a length of 25 inches. The plate 20 has square cut channels, each 3 inches wide and 0.5 inches deep.

The embodiment shown in FIG. 1 shows undulating downward slope angle. It is apparent that a uniformed downward slope angle could also be used. It is also apparent that the beverage 50 could be flowed down a plate having a 'stair-step' downward slope angle. The 'stair step' downward slope would have a series of horizontal and vertical surfaces that would comprise the slope of the plate 20 and the embedded conduit 40.

Figure 3A:
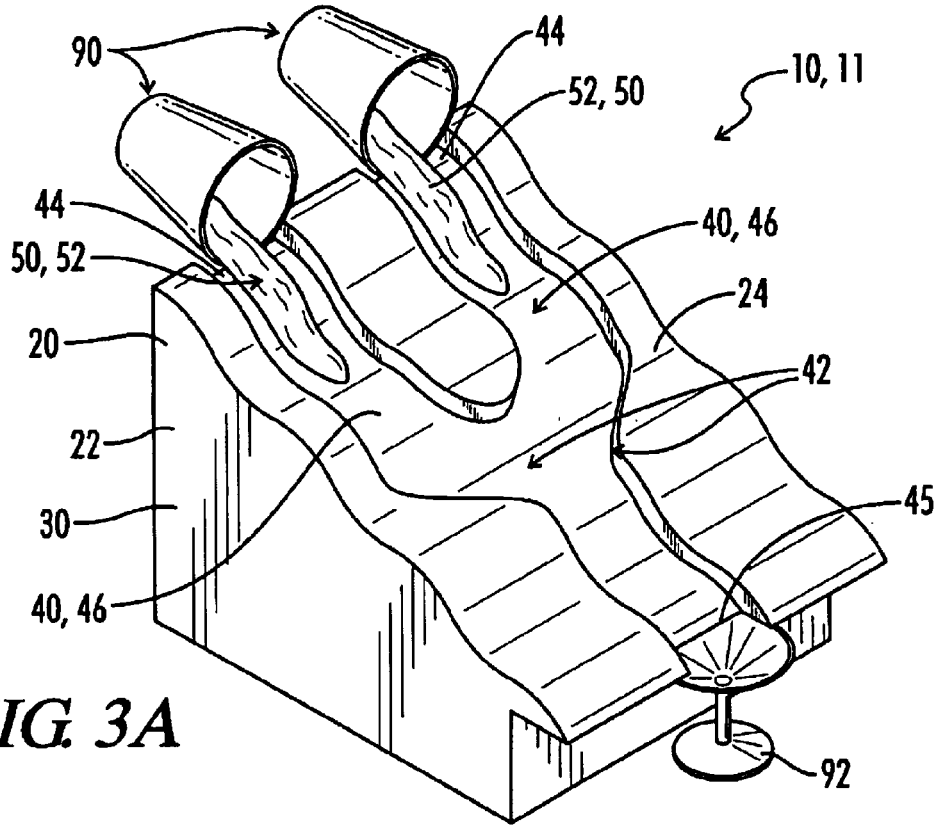
FIGS. 3(*a*) and (*b*) are the profiles of the invention of FIG. 1 showing, respectively, multiple beverage entries and multiple beverage exits.
Figure 3B:
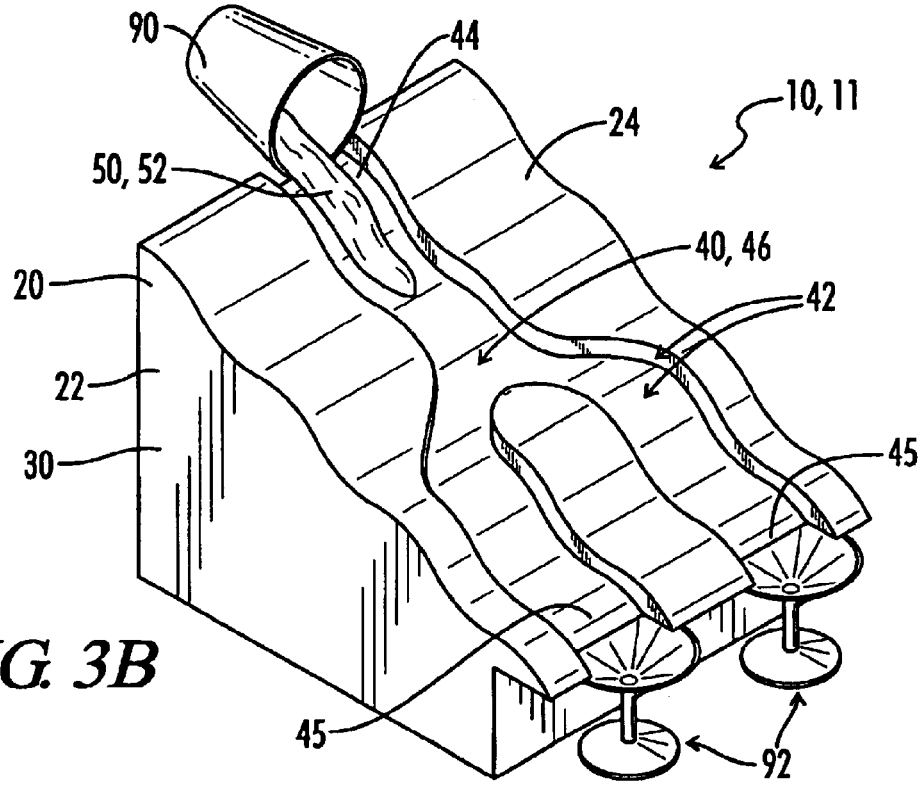

Now referring to FIGS. 3(*a*) and 3(*b*), the embodiment of FIG. 1 is shown modified to have, respectively, multiple beverage entries 44 and multiple beverage exits 45. The usefulness of this embodiment is that, in FIG. 3(*a*), component beverage materials 52 could be flowed down in different beverage entries 44 to mix and create the chilled beverage 50 received in the receptacle 92. Alternately, using the embodiment of FIG. 1, component beverage materials 52 could be sequentially flowed down the beverage entry 44 to mix and create the chilled beverage 50 received in the receptacle 92.

Figure 2:
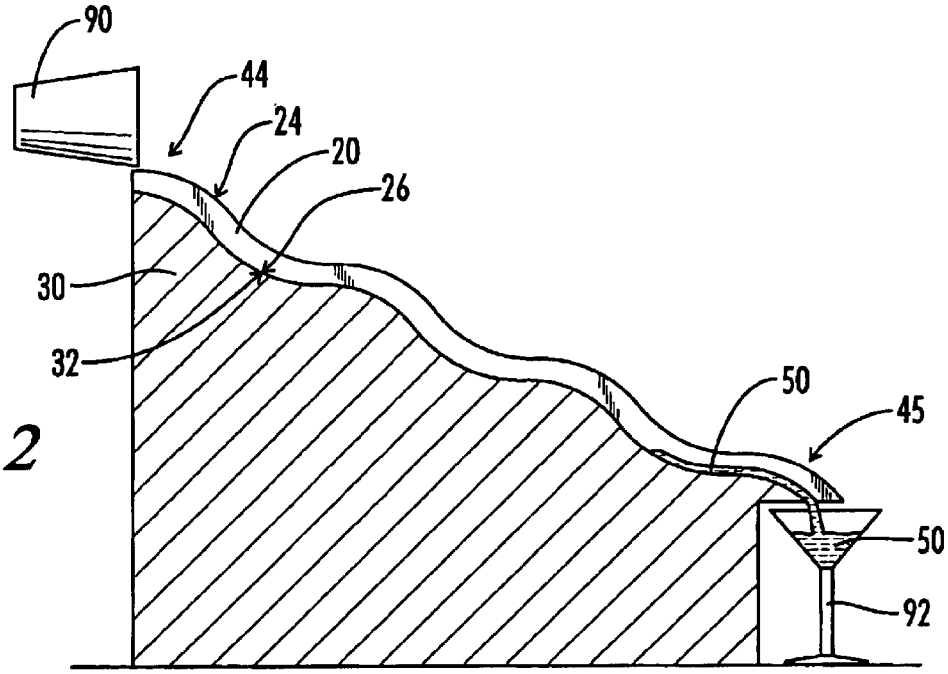
FIG. 2 is a profile of the present invention showing separate base blocks and plate.

Now referring to FIG. 2, shows an alternative embodiment of this invention having a plate 20 disposed on a base block 30 wherein the plate 20 and base block 30 are comprised of different materials. This has the advantage that the plate 20 can be made from highly purified or more costly or otherwise desirable materials. For example, the frozen plate materials 22 can comprise beverage materials and other similar frozen materials. The heat absorbed by the plate 20 in chilling the beverage 50 can melt or partially melt portions of the frozen plate materials 22 comprising the conduit surface 42. These melted frozen plate materials 22 enter the chilled beverage 50. The advantage of selecting the composition of the frozen plate materials 22 is that warmer beverages 50 can be chilled without dilution of the mixture. Alternately, materials that significantly alter the taste of a beverage in small quantities can be selected as components of the frozen plate materials 22. This would result in a unique mechanism for flavoring a chilled beverage 50. Structurally, FIG. 2 further shows that the base block surface 32 in contact with and supporting the inner plate surface 26.

The method of using the invention is depicted in FIGS. 1, 2, 3(*a*) and 3(*b*). The process consist of orienting the apparatus 10 wherein the plate 20 has a downward slope angle in relation to vertical. After the apparatus 10 is properly oriented, a pouring receptacle 90 containing a beverage 50 is brought to the top of the apparatus 10 and the beverage 50 is poured into the beverage entry 40 of a conduit 40. The beverage 50 flows along the conduit surface 42 and is chilled by direct contact with the conduit surface 42 as it flows along a substantial length of the conduit 40. The chilled beverage 50 then flows out of the beverage exit 45 and is collected as a chilled beverage in a serving receptacle 92. This process can be modified wherein the beverage 50 contains at least two components beverage materials 52 which are either mixed in the pouring receptacle 90 or are flowed individually, either simultaneously as in FIG. 3(*a*) or sequentially as shown in FIG. 1, and mixed in the conduit 40 or the serving receptacle 92.

The process of preparing the chilled beverage 50 can be further modified by selection of the component materials comprising the frozen plate material 22. If ordinary ice is used, a portion of the frozen plate material 22 comprising the conduit surface will melt and slightly dilute the beverage. As described above, if components beverage materials 52 comprise the frozen plate material 22, dilution can be avoided. However, if a substance such as dry ice is used, it will exist at a substantially lower temperature than the freezing point of at least some of the components beverage materials 52. Then, portions of the components beverage materials 52 maybe solidified and frozen to the conduit surface 42. This would also change the composition of the beverage 50. For example, if an alcoholic beverage 50 having an alcohol/water mixture were poured down a significant length conduit 40 in a plate 20 comprised of dry ice, the concentration of the alcohol could be greatly increased by freezing and precipitating as ice a substantial amount of the water of the alcohol/water mixture. The alcohol concentration of chilled beverage 50 collected in the serving receptacle 92 maybe significantly higher than the alcohol concentration of the beverage 50 flowed into the beverage entry.

Figure 4:
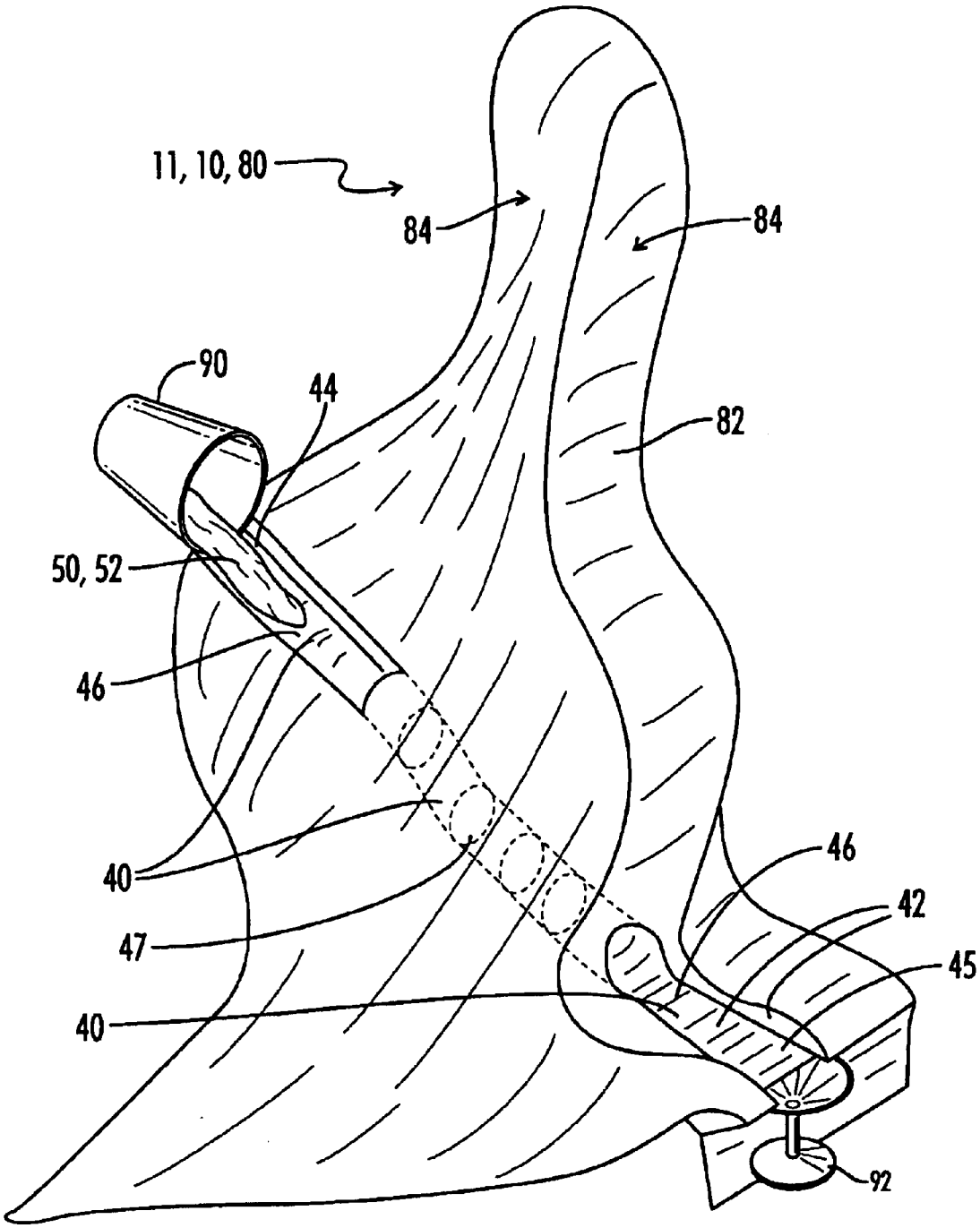
FIG. 4 shows an ice sculpture of the present invention having both an open canal conduit combined with a closed tube conduit.

Referring now to FIG. 4, a sculpture 80 embodiment of this invention is shown, the sculpture surface 84 can be fashioned by hand, by machining or by molding. The sculpture 80 shows a conduit 40 for receiving, transporting, chilling and delivering a beverage 50. The embodiment of FIG. 4 shows a conduit 40 having both an open channel portion 46 and closed tube portion 47. The sculpture 80 can be sculpted from frozen material 82 such similar to that described of FIGS. 1, 2, 3(*a*) and 3(*b*). The sculpture 80 could alternately comprise a non-melting frozen material, such as a Lucite or similar material that is formed, shaped and then frozen relative to the temperature to the beverage 50.

Figure 5:
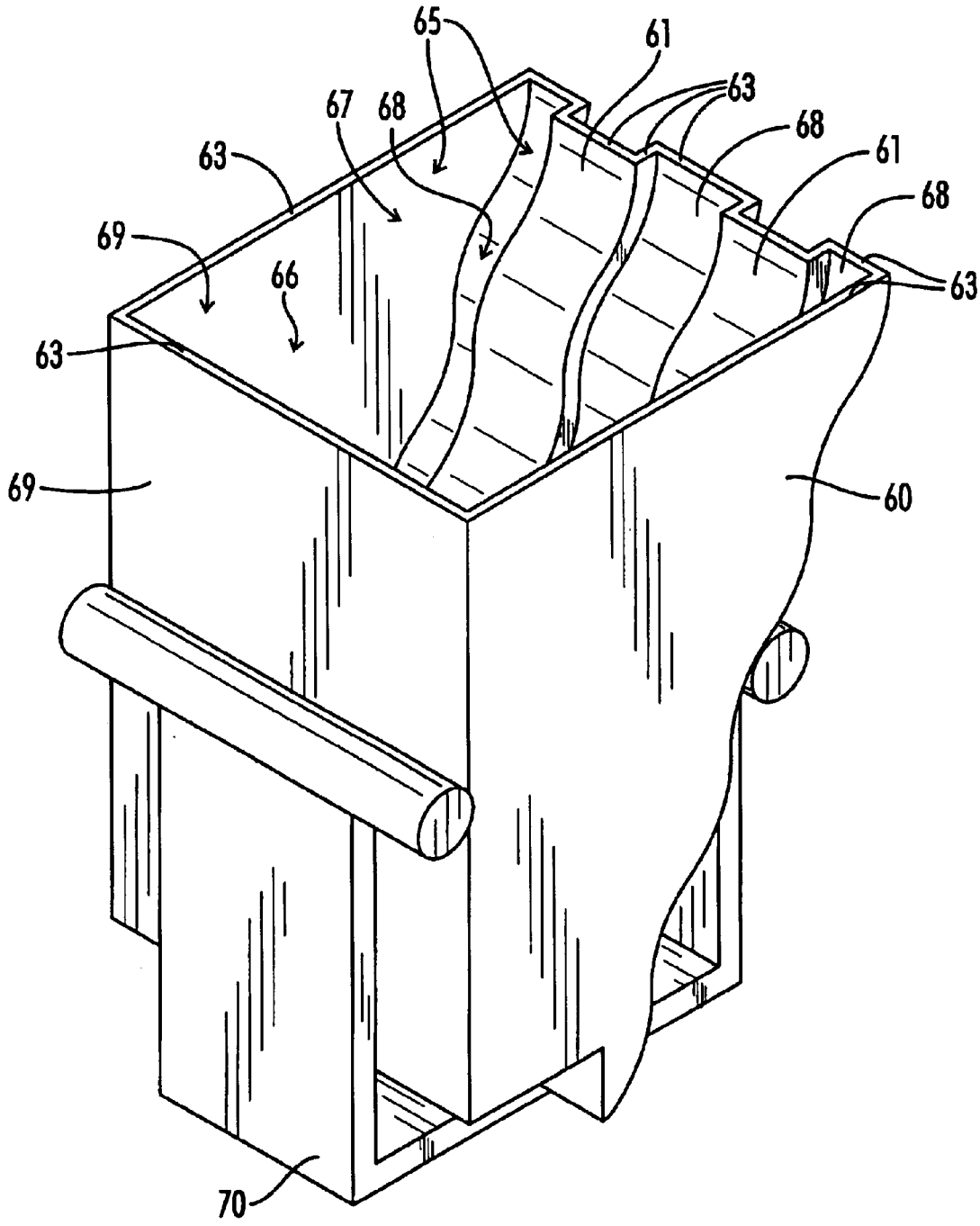
FIG. 5 is a mold of the present invention showing a flexible latex molding device.

Referring to FIG. 5 and FIG. 1, in particular FIG. 5, shows a mold die 60 for freezing liquid materials to form a frozen casting 11, the frozen casting 11 being the invention of FIG. 1. FIG. 5 shows mold walls 63 comprised of a mold forming material 64. The mold walls 63 have a interior mold wall surfaces 65 which defines a mold cavity 66. The mold cavity 66 receives the liquid material is received which is subsequently frozen to form the frozen casting of FIG. 1. Referring again to FIG. 5, the mold die has a opening 67 at one end for receiving the freezable liquids such as water, ice water mixtures, fruit juices, etc. The mold die 60 has a mold plate surface 68 against which the outer plate surface of the casting 11 is cast. The mold wall extension surface 61 protrudes into the mold cavity 66 to create the conduits 40 within the plate 20. This embodiment shows the mold wall extension surface 68 so arrange to as cast an open channel conduit 40, 46 within the frozen casting 11. The mold base block surface 69 comprises the remaining interior walls of the mold die 60 and is used to cast the base block surface 32. In this embodiment, mold die 60 is typically use to produce a plate 20 and base block 30 that are interval to one another and are formed in the same casting. Alternately, the mold die could be use to sequentially cast the plate 20 and then the base block 30 of the frozen casting 11. This would allow use of different materials in for the frozen plate materials 22 than those materials comprising the base block 30.

The mold die 60 can be comprised of a resilient flexible material such as latex or rubber. The mold die 60 is shaped to have a plate shown herein to have undulating downward slope angle when the frozen casting 11 of the mold die 60 is properly orientated for use. However, other slope angles, such as a uniform downward sloped angle or a stair step slope angle, could be incorporated. An alternative, more complex mold die could be used to form a closed tube for at least a portion of the length of the conduit of the casting.

Thus, although there have been described particular embodiments of the present invention of a new and useful "Apparatus and Method for Preparing, Chilling and Dispensing a Beverage," it is not intended that such references be construed as limitations upon the scope of this invention except as set forth in the following claims.

What is claimed is:

1. An apparatus for preparing, chilling and dispensing a beverage comprising:

a plate comprised of a frozen plate material and having an outer plate surface and an inner plate surface, said plate arranged in a slope having a downward slope angle when the apparatus is oriented for use;

a base block having a base block surface, said base block surface disposed so as to contact and support the inner plate surface; and a conduit having a conduit surface comprising a portion of the frozen plate material, said conduit so disposed within the plate so as to flow a beverage through the plate, and said conduit having a beverage entry disposed at the outer plate surface and having a beverage exit disposed at the outer plate surface, wherein said beverage entry is up-slope of said beverage exit, wherein a beverage flowed into the beverage entry directly contacts the frozen plate material disposed in the surface of the conduit, is chilled thereby and is flowed out the beverage exit.

2. The apparatus of claim 1 wherein the frozen plate material comprises ice.

3. The apparatus of claim 1 wherein the frozen plate material comprises dry ice.

4. The apparatus of claim 1 wherein the frozen plate material comprises frozen beverage materials.

5. The apparatus of claim 4 wherein the frozen beverage materials are selected from the group water, ice-water, alcoholic beverages, carbonated beverages, flavored beverages, teas, coffees, juices, portions of solidified fruit, spices or flavoring agents.

6. The apparatus of claim 1 wherein the plate is arranged in a slope having a undulating downward slope angle.

7. The apparatus of claim 1 wherein the plate is arranged in a slope having a uniform downward slope angle.

8. The apparatus of claim 1 wherein the plate is arranged in a slope having a stair-step downward slope angle.

9. The apparatus of claim 1 wherein the conduit surface forms an open channel for at least a portion of the length of the conduit.

10. The apparatus of claim 1 wherein the conduit surface forms a closed tube for at least a portion of the length of the conduit.

11. The apparatus of claim 1 wherein the conduit has at least two beverage entries.

12. The apparatus of claim 1 wherein the conduit has at least two beverage exits.

13. The apparatus of claim 1 wherein the base block comprises ice.

14. The apparatus of claim 1 wherein the base block comprises dry ice.

15. The apparatus of claim 1 wherein the base block comprises frozen beverage materials.

16. The apparatus of claim 15 wherein the frozen beverage materials are selected from the group water, ice-water, alcoholic beverages, carbonated beverages, flavored beverages, teas, coffees, juices, portions of solidified fruit, spices or flavoring agents.

17. The apparatus of claim 1 wherein the plate and the base block are integrally formed.

18. A process of preparing and dispensing a chilled beverage comprising:

(a) providing a plate comprised of a frozen plate material, said plate having a conduit disposed therein:

wherein said plate, having an outer plate surface and an inner plate surface, is arranged in a slope having a downward slope angle;

wherein a base block, having a base block surface, is disposed so as to contact and support the inner plate surface; and wherein said conduit, having a conduit surface comprising the frozen plate material of the plate and having a beverage entry and an beverage exit, is disposed within the plate such that said beverage entry is up-slope of said beverage exit;

(b) flowing a beverage into the beverage entry;

(c) chilling the beverage by directly contacting the beverage with frozen plate material disposed in the surface of the conduit along a substantial length of the conduit;

(d) flowing the chilled beverage into the beverage exit; and (c) collecting the chilled beverage in a container.

19. The process of claim 18 wherein the beverage comprises at least two component beverage materials.

20. The process of claim 19 wherein step (b) further comprises sequentially flowing the components beverage materials into the beverage entry.

21. The process of claim 18 wherein the conduit has at least two beverage entries or at least two beverage exits.

22. The process of claim 21 wherein step (b) further comprises flowing the beverage into at least two beverage entries or into at least two beverage exits.

23. The process of claim 18 wherein step (c) further comprises melting a portion of frozen plate material contacting the beverage flowing in the conduit and dissolving said portion of frozen plate material into the beverage.

24. The process of claim 18 wherein step (c) further comprises freezing a portion of the beverage flowing in the conduit and contacting the frozen plate material therein.

25. The process of claim 18 wherein the frozen plate material comprises ice.

26. The process of claim 18 wherein the frozen plate material comprises dry ice.

27. The process of claim 18 wherein the frozen plate material comprises frozen beverage materials.

28. The process of claim 27 wherein the frozen beverage materials are selected from the group water, ice-water, alcoholic beverages, carbonated beverages, flavored beverages, teas, coffees, juices, portions of solidified fruit, spices or flavoring agents.

29. A mold die for freezing liquid materials to cast a frozen casting, said frozen casting for preparing and dispensing a chilled beverage, said mold die comprising:

mold walls comprising a mold forming material, said mold walls having interior mold wall surfaces defining a mold cavity for forming a frozen casting;

an opening at one end for receiving freezable liquids;

a mold plate surface comprising a portion of the interior mold wall surfaces, said mold plate surface arranged so as to form, during casting, an outer plate surface of a plate of the frozen casting, wherein said plate is arranged in a slope having a downward slope angle when the frozen casting is oriented for use;

a mold base block surface comprising a portion of the interior mold wall surfaces, said mold base block surface arranged so as to form, during casting, a base block of the frozen casting, wherein said base block is disposed so as to contact and support the plate of the frozen mold cast, and wherein the plate and the base block are integrally formed; and a mold wall extension surface, said mold wall extension surface protruding from the mold plate surface into the mold cavity and arranged so as to form, during casting, a conduit disposed within the plate of the frozen casting, said conduit having a surface comprising a portion of the frozen casting and having a beverage entry and an beverage exit, wherein, when the frozen mold cast is oriented for use, said conduit is suitable for flowing a beverage through the plate, wherein said beverage entry is up-slope of said beverage exit, and wherein a beverage so flowed into the beverage entry directly contacts the frozen mold cast disposed in the surface of the conduit, is chilled thereby and is flowed out the beverage exit.

30. The mold die of claim 29 wherein the mold forming material is resilient, flexible material.

31. The mold die of claim 29 wherein the plate is arranged in a slope having a undulating downward slope angle.

32. The mold die of claim 29 wherein the plate is arranged in a slope having a uniform downward slope angle.

33. The mold die of claim 29 wherein the plate is arranged in a slope having a stair-step downward slope angle.

34. The mold die of claim 29 wherein the conduit surface forms an open channel for at least a portion of the length of the conduit.

35. The mold die of claim 29 wherein the conduit surface forms a closed tube for at least a portion of the length of the conduit.

36. The mold die of claim 29 wherein the conduit has at least two beverage entries.

37. The mold die of claim 29 wherein the conduit has at least two beverage exits.

38. An apparatus for preparing and dispensing a chilled beverage comprising:

a sculpture having a sculpture surface, said sculpture comprising of a frozen material;

a conduit disposed within the sculpture so as to flow a beverage, said conduit having a conduit surface comprising portions of the frozen material, and said conduit having a beverage entry disposed at the sculpture surface and an beverage exit disposed at the sculpture surface, wherein said beverage entry is above said beverage exit when the sculpture is oriented for use, wherein a beverage flowed into the beverage entry directly contacts the frozen material disposed in the surface of the conduit, is chilled thereby and is flowed out the beverage exit.

39. The apparatus of claim 38 wherein the frozen material comprises ice.

40. The apparatus of claim 38 wherein the frozen material comprises dry ice.

41. The apparatus of claim 38 wherein the frozen material comprises frozen beverage materials.

42. The apparatus of claim 41 wherein the frozen beverage materials are selected from the group water, ice-water, alcoholic beverages, carbonated beverages, flavored beverages, teas, coffees, or juices.

43. The apparatus of claim 38 wherein the conduit surface forms an open channel for at least a portion of the length of the conduit.

44. The apparatus of claim 38 wherein the conduit surface forms a closed tube for at least a portion of the length of the conduit.

45. The apparatus of claim 38 wherein the conduit has at least two beverage entries.

46. The apparatus of claim 38 wherein the conduit has at least two beverage exits.

* * * * *